US005851975A

United States Patent [19]

Kiuchi et al.

[11] Patent Number: 5,851,975

[45] Date of Patent: Dec. 22, 1998

[54] ENZYME-CONTAINING GRANULATED SUBSTANCE AND PREPARATION PROCESS THEREOF

[75] Inventors: Toshihiro Kiuchi, Ibaraki; Kohtaro Sano, Wakayama; Manabu Sato, Ibaraki; Jyo Kawamura, Ibaraki; Naoto Yamada, Ibaraki, all of Japan

[73] Assignee: Kao Corporation, Tokyo, Japan

[21] Appl. No.: 776,437

[22] PCT Filed: May 24, 1996

[86] PCT No.: PCT/JP96/01400

§ 371 Date: Jan. 28, 1997

§ 102(e) Date: Jan. 28, 1997

[87] PCT Pub. No.: WO96/38527

PCT Pub. Date: Dec. 5, 1996

[30] Foreign Application Priority Data

May 29, 1995 [JP] Japan ..... 7-130255

[51] Int. Cl.[6] ..... C11D 3/386

[52] U.S. Cl. ..... 510/320; 510/348; 510/349; 510/392; 510/530

[58] Field of Search ..... 510/320

[56] References Cited

U.S. PATENT DOCUMENTS

| | | | |
|---|---|---|---|
| 4,661,452 | 4/1987 | Markussen et al. | 435/187 |
| 4,689,297 | 8/1987 | Good et al. | 435/174 |
| 4,863,626 | 9/1989 | Coyne et al. | 252/91 |
| 4,973,417 | 11/1990 | Falholt | 252/95 |
| 5,093,021 | 3/1992 | Coyne et al. | 252/91 |
| 5,225,102 | 7/1993 | Coyne et al. | 252/186.26 |
| 5,254,287 | 10/1993 | Deleeuw et al. | 252/186.27 |
| 5,324,649 | 6/1994 | Arnold et al. | 435/187 |
| 5,719,115 | 2/1998 | Paatz et al. | 510/392 |

FOREIGN PATENT DOCUMENTS

| | | |
|---|---|---|
| 43 22 229 A1 | 1/1995 | Germany . |
| 62-257990 | 11/1987 | Japan . |
| 3-111497 | 5/1991 | Japan . |
| WO 87/07292 | 12/1987 | WIPO . |
| WO 89/08695 | 9/1989 | WIPO . |
| WO 90/09428 | 8/1990 | WIPO . |
| WO 94/26883 | 11/1994 | WIPO . |

OTHER PUBLICATIONS

Chemical Abstract 105: 228951h Composite enzyme granules for laundry detergents. Onoda et al., 1986.

Chemical Abstract 105: 228952j Liquid detergent compositions. Maurai et al., 1986.

Chemical Abstract 105: 228953k Water–based laundry detergent. Daurov et al., 1986.

Japanese Abstract JP61107935 Enzyme granule and its coloration. Masayuki et al., May 1986.

*Primary Examiner*—Ellen M. McAvoy

*Attorney, Agent, or Firm*—Birch, Stewart, Kolasch & Birch, LLP

[57] ABSTRACT

The present invention relates to an enzyme-containing granulated substance comprising an enzyme-containing particulate substance and a coating layer which is formed on the particulate substance and comprises (a) water-insoluble or hardly water-soluble inorganic particles having an average particle diameter of 1 to 100 $\mu$m, (b) water-insoluble or hardly water-soluble inorganic particles having an average particle diameter of 0.01 to 0.8 $\mu$m and (c) a binder, and a preparation process thereof. The enzyme-containing granulated substance is not only high in productivity but also low in dusting characteristics and high in storage stability, and is hence useful as a formulation ingredient for detergents, in particular, bleacher-containing detergents.

17 Claims, No Drawings

ENZYME-CONTAINING GRANULATED SUBSTANCE AND PREPARATION PROCESS THEREOF

TECHNICAL FIELD

The present invention relates to an enzyme-containing granulated substance useful as a formulation ingredient for detergents, and particularly to an enzyme-containing granulated substance excellent in enzyme stability, free of dusting characteristics and good in productivity.

BACKGROUND ART

Various kinds of enzymes are often incorporated in laundry detergents and bleaching agents in addition to surfactants and bleaching ingredients with a view toward enhancing detergent action. These enzymes are generally granulated in the form of granules before their incorporation with a view toward preventing deactivation during their storage and causing them to sufficiently exhibit their activities in a washing process.

Such enzyme-containing granulated substances are known to lower the stability of the enzyme when they are blended with bleaching agents, surfactants, builders and the like, and to markedly reduce the activity of the enzyme when blending with, in particular, the bleaching agents. In granulated substances for detergents, taking into consideration the lowering of productivity due to classification, and the like, it is necessary that their particle diameters, bulk specific gravities and the like should be controlled at a certain measure of option. In particular, there is a demand for development of a granulated substance narrow in particle size distribution and high in productivity. Since operators upon preparation and consumers need to avoid direct contact with the enzyme, there is also a demand for development of a granulated substance free of dusting characteristics.

In order to solve these problems, the present inventors previously found that when an agitating and rolling granulator is used, an enzyme-containing granulated substance narrow in particle size distribution can be obtained with high productivity, and filed an application for patent (JP-A-62-257990(1987)).

However, even the granulated substance obtained by this rolling granulator was not yet fully satisfactory from the viewpoint of storage stability of the enzyme contained therein, dusting characteristics and the like. That is, the relationship between the storage stability of an enzyme contained in granulated substances and their dusting characteristics, and the compositions of the granulated substances is important.

Accordingly, it is an object of the present invention to provide an enzyme-containing granulated substance free of dusting characteristics and good in storage stability of the enzyme contained therein and productivity, a preparation process thereof and a detergent composition comprising this substance.

DISCLOSURE OF THE INVENTION

This object has been achieved by the surprising finding that when a particulate substance containing an enzyme is used as a nucleus and coated with two or more kinds of water-insoluble or hardly water-soluble inorganic particles and a binder in combination, a granulated substance scarcely having dusting characteristics and having far excellent storage stability can be obtained.

According to the present invention, there is thus provided an enzyme-containing granulated substance comprising an enzyme-containing particulate substance and a coating layer which is formed on the particulate substance and comprises (a) water-insoluble or hardly water-soluble inorganic particles having an average particle diameter of 1 to 100 $\mu$m, (b) water-insoluble or hardly water-soluble inorganic particles having an average particle diameter of 0.01 to 0.8 $\mu$m and (c) a binder.

According to the present invention, there is also provided a process for the preparation of an enzyme-containing granulated substance, comprising forming, on an enzyme-containing particulate substance, a coating layer comprising (a) water-insoluble or hardly water-soluble comprising (a) water-insoluble or hardly water-soluble inorganic particles having an average particle diameter of 1 to 100 $\mu$m, (b) water-insoluble or hardly water-soluble inorganic particles having an average particle diameter of 0.01 to 0.8 $\mu$m and (c) a binder.

BEST MODE FOR CARRYING OUT THE INVENTION

As described above, the granulated substance according to the present invention is characterized in that an enzyme-containing particulate substance is used as a nucleus, and the nucleus is coated with a layer containing the above components (a), (b) and (c).

The enzyme-containing particulate substance used as the nucleus in the granulated substance according to the present invention may be any of (1) a particulate substance composed of an enzyme by itself, (2) a particulate substance including an enzyme and particles of a water-soluble substance having a particle diameter of 0.2 to 1.2 mm, (3) a particulate substance including an enzyme, particles of a water-soluble substance having a particle diameter of 0.2 to 1.2 mm and a binder, (4) a particulate substance including an enzyme, particles of a water-soluble substance having a particle diameter of 0.2 to 1.2 mm, a binder and the component (a), (5) a particulate substance including an enzyme, particles of a water-soluble substance having a particle diameter of 0.2 to 1.2 mm, a binder and the component (b), and (6) a particulate substance including an enzyme, particles of a water-soluble substance having a particle diameter of 0.2 to 1.2 mm, a binder and the components (a) and (b).

No particular limitation is imposed on the enzyme used in the present invention. The enzyme may for instance be selected from proteases, esterases and carbohydrases or a mixture thereof.

Specific examples of the proteases may be pepsin, trypsin, chymotrypsin, collagenase, keratinase, elastase, subtilisin, papain, aminopeptidase and carboxypeptidase.

Specific examples of the esterases may be gastric lipase, pancreatic lipase, plant lipases, phospholipases, cholinesterases and phosphatases.

Specific examples of the carbohydrases, may be cellulase, maltase, saccharase, amylase, pectinase and $\alpha$- and $\beta$-glycosidases.

Enzymes produced by microorganisms obtained by culturing are preferred for detergents from the viewpoint of price. With respect to such an enzyme produced by microorganisms, it is preferable to use it in the form of powder, which is generally formed by drying after culture and isolation. Its average particle diameter is desirably at most 20% of the average particle diameter of the particles of the water-soluble substance. Upon the formation of the powder, an enzyme stabilizer such as calcium chloride and an auxiliary for the formation of powder, such as Glauber's salt or sodium chloride may be incorporated.

The particles of the water-soluble substance having an average particle diameter of 0.2 to 1.2 mm are particles which act as nuclei in the preparation step of the enzyme-containing particulate substance. Examples thereof include particles of sodium chloride, potassium chloride, Glauber's salt, sodium carbonate and sugar, with sodium chloride particles being particularly preferred.

Incidentally, the average particle diameter and particle size distribution (by volume) in the present invention were determined by means of a laser diffraction type particle size distribution measuring apparatus SALD-1100 Model (manufactured by Shimadzu Corporation).

It is desirable that the particle size distribution of the particles of the water-soluble substance be as narrow as possible. In particular, it is preferable to remove coarse particles having a size of at least twice of the average particle diameter in advance.

It is also desirable that the particles of the water-soluble substance have a melting point or softening point of 80° C. or higher. Further, those low in hygroscopicity, high in mechanical strength and slight in tackiness are particularly preferred.

As examples of the component (a), i.e., the water-insoluble or hardly water-soluble inorganic particles having an average particle diameter of 1 to 100 μm, may be mentioned particles of talc, titanium oxide, calcium carbonate, zeolite, magnesium carbonate, activated clay and kaolin. Of these, particles of talc, calcium carbonate, zeolite, magnesium carbonate, activated clay and kaolin are preferred. These particles may be used in any combination thereof so far as the average particle diameter of the resulting mixture falls within the above range. The particles preferably have an average particle diameter of 2 to 80 μm, particularly preferably 2 to 60 μm.

As examples of the component (b), i.e., the water-insoluble or hardly water-soluble inorganic particles having an average particle diameter of 0.01 to 0.8 μm, may be mentioned particles of the same compounds as those mentioned as the component (a). Of these, particles of titanium oxide are particularly preferred. These particles may be used in any combination thereof so far as the average particle diameter of the resulting mixture falls within the above range. The particles preferably have an average particle diameter of 0.1 to 0.8 μm, particularly preferably 0.1 to 0.6 μm.

The most important feature of the present invention resides in that the two kinds of the water-insoluble or hardly water-soluble inorganic particles different in average particle diameter, i.e., the components (a) and (b), are used in combination in the coating layer. The combined use of the components (a) and (b) permits the formation of a strong coating layer low in dusting characteristics on the particulate substance, and so the storage stability of the enzyme contained in the resulting granulated substance is improved.

The binder (c) used in the present invention is preferably a water-soluble organic compound having a melting point or softening point of 35° to 70° C. As specific examples of the binder, may be mentioned nonionic surfactants such as polyethylene glycol, polyoxyethylene-polyoxypropylene glycol and polyoxyethylene alkyl ethers. These compounds may be used either singly or in any combination thereof.

In order to stabilize the enzyme contained in the granulated substance according to the present invention, any of inorganic salts such as various calcium salts and magnesium salts, or organic substances such as surfactants, saccharides and carboxymethylcellulose may be used. Further, synthetic hectorite or sepiolite may be incorporated to adsorb odorous components derived from the culture. Coloring matter or a dye may be optionally incorporated to color the enzyme granules or particles. These ingredients may be added in any way of adding them in advance in the preparation step of the enzyme powder, of adding them in the preparation step of the enzyme-containing particulate substance and of adding them in the coating step according to the present invention.

In the granulated substance according to the present invention, no particular limitation is imposed on the weight ratio of the enzyme-containing particulate substance to the coating layer. However, it is preferably within a range of 1:0.1 to 1:0.7, particularly 1:0.2 to 1:0.6. The weight ratio of the component (a) to the component (b) is preferably within a range of 1:0.1 to 1:1, more preferably 1:0.1 to 1:0.5. The weight ratio of the total of the components (a) and (b) to the component (c) is preferably within a range of 1:0.05 to 1:1, more preferably 1:0.08 to 1:0.3.

Further, no particular limitation is imposed on the blending proportions of the individual components in the case where the particles of the water-soluble substance are contained in the enzyme-containing particulate substance. It is however preferable that the granulated substance should contain the enzyme, the component (a), the component (b) and the component (c) in proportions of 10 to 100 parts by weight, 40 to 120 parts by weight, 10 to 50 parts by weight and 10 to 60 parts by weight, respectively, per 100 parts by weight of the particles of the water-soluble substance.

The enzyme-containing granulated substance according to the present invention is prepared by first preparing the enzyme-containing particulate substance having any constitution of the above-described constitutions (1) to (5) and then coating this particulate substance with the components (a), (b) and (c).

In the present invention, both preparation of the enzyme-containing particulate substance and coating are preferably performed in accordance with a dry granulation process. Of these steps, the coating is more preferably performed in accordance with a agitating and rolling granulation process. It is particularly preferable to perform both steps in accordance with the agitating and rolling granulation process.

As specific examples of the agitating and rolling granulator, may be mentioned a Henschel mixer (manufactured by Mitsui Miike Engineering Corporation), a high-speed mixer (manufactured by Fukae Kogyo K.K.) and a vertical granulator (manufactured by Fuji Sangyo Co., Ltd.). The point of sameness of these machines is that a vertical agitation shaft equipped with agitating blades is held in the interior of a vertical mixing drum. A Reddige mixer (manufactured by Reddige Co.), which is a model granulator having a horizontal agitation shaft, may also be used.

A description will be given taking, as an example, the case where both preparation of the enzyme-containing particulate substance and coating are performed by the agitating and rolling granulation.

An enzyme, particles of a water-soluble substance, a binder and other optional ingredients are charged into a drum of a agitating and rolling granulator and moderately stirred and mixed while circulating a heating medium such as hot water in a jacket of the granulator. When the contents are vigorously mixed at this point of time, the destruction of the particles of the water-soluble substance occurs. Therefore, the mixing must be carefully carried out. When the temperature of the raw materials in the drum exceeds the melting point or softening point of the binder before long granulation begins centering around the particles of the water-soluble substance. The granules formed are given rolling action on the surfaces of the agitating blades, thereby forming spherical particles. A further mixing is not preferable because coarse agglomerate may be formed due to the aggregation between the particles and thermal action given to the enzyme also becomes greater. The detection of the end point of optimum granulation is easily conducted by making good use of the fact that power (for example, electric current value) required for agitation generally becomes greater when the granulation begins, and preliminarily making trial with the composition of the intended granulated substance and an agitating and rolling granulator to be used. After a primary granulated substance (an enzyme-containing particulate substance) is obtained in such a manner, it is only necessary to charge components (a), (b) and (c) and other optional ingredients into the drum so as to carry out the same operation as described above.

The enzyme-containing granulated substance thus obtained may also be coated with polyethylene glycol or a nonionic surfactant as needed.

EXAMPLES

The present invention will hereinafter be described in more detail by the following examples. However, it should be born in mind that the invention is not limited to these examples.

Example 1

Raw materials of the following composition were processed by means of a high-speed mixer (FS-5 model, manufactured by Fukae Kogyo K.K.) to obtained an enzyme-containing granulated substance A.

| Composition: | (wt. %) |
|---|---|
| Sodium chloride (average particle diameter: 610 μm, containing 11% of particles of 500 μm or smaller and 9% of particles of 700 μm or greater) | 72.0 |
| Polyethylene glycol 6000 (product of Kao Corporation) | 4.0 |
| Enzyme powder (WO 94/26881)*[1] | 18.5 |
| Titanium oxide (average particle diameter: 0.27 μm) | 5.5 |

*[1]Enzyme powder (WO 94/26881); using powder having an average particle diameter of 20 μm obtained by adding Glauber's salt to an aqueous solution of alkaline α-amylase collected by the culture of a strain (deposition number of the microorganism: FRI Deposition No. 10886) belonging to the genus Bacillus and drying the mixture by a parallel flow type spray dryer. The amount of Glauber's salt was 48% based on the dry powder.

All the above raw materials (total weight: 2 kg) were charged in the mixer, and stirred and mixed at rates of 360 rpm for agitator and 900 rpm for chopper while circulating hot water of 70° C. in a jacket. After raising the temperature of the contents to 65° C., the circulation of the hot water was stopped. By the granulating operation for about 15 minutes from the charging of the raw materials, an enzyme-containing primary granulated substance was obtained.

Added to the thus-obtained primary granulated substance were talc (average particle diameter: 36 μm) as the component (a), titanium oxide (average particle diameter: 0.27 μm) as the component (b) and polyethylene glycol 6000 as the binder (c) at the same time to carry out the granulating operation further for about 10 minutes, thereby obtaining the enzyme-containing granulated substance A. The granulated substance A was recovered in a high yield as demonstrated by the fact that granules not smaller than 350 μm but not greater than 1,000 μm were contained in a proportion of at least 98%.

For the sake of comparison, titanium oxide (average particle diameter: 0.27 μm) and particles (average particle diameter: 16 μm) of sodium sulfate, which was water-soluble, were used as two kinds of particles different in particle diameter to carry out a granulating operation in the same manner as described above, thereby obtaining an enzyme-containing granulated substance B. The resultant enzyme-containing granulated substances A and B in amounts of 0.1 g were separately stored in 10 g of a percarbonate as a bleaching agent under conditions of 40° C. and 80% relative humidity to determine the storage stability of the enzyme. The results are shown in Table 1.

TABLE 1

| Granulated substance | Component (a) | Component (b) | Binder | Retention of activity (seventh day) |
|---|---|---|---|---|
| A | Talc 27%* | Titanium oxide 4% | 3% | 30% |
| B | Sodium sulfate 27% | Titanium oxide 4% | 3% | 3% |

*Each blending amount is wt. % based on the total weight of the granulated substance.

As apparent from Table 1, it is understood that the enzyme-containing granulated substance of the present invention comprising the components (a) and (b) according to the present invention is far excellent in storage stability. Besides, the granulated substance according to the present invention was observed scarcely having dusting characteristics.

Example 2

Alkaline cellulase (Japanese Patent Application Laid-Open No. 145199/1982) was used as enzyme powder. More specifically, powder having an average particle diameter of 50 μm obtained by adding calcium chloride and Glauber's salt to an aqueous solution of alkaline cellulase collected by the culture of a strain (deposition number of the microorganism: FRI Deposition No. 1138) belonging to the genus Bacillus and drying the mixture by a parallel flow type spray dryer was used. The amounts of calcium chloride and Glauber's salt was 0.5% and 48%, respectively, based on the dry powder.

Using the enzyme powder thus obtained, a primary granulated substance was prepared in the same manner as in Example 1.

Added to the thus-obtained primary granulated substance were two kinds of particles different in particle diameter, i.e., titanium oxide (average particle diameter: 0.27 μm) and particles selected from talc (average particle diameter: 36 μm), zeolite (average particle diameter: 5.2 μm), kaolin (average particle diameter: 5.2 μm) and activated clay (average particle diameter: 11.7 μm), and polyethylene glycol 6000 as the binder at the same time to carry out the granulating operation further for about 10 minutes, thereby obtaining enzyme-containing granulated substances C to F. Each of the granulated substances C to F was recovered in a high yield as demonstrated by the fact that granules not smaller than 350 μm but not greater than 1,000 μm were contained in a proportion of at least 98%.

For the sake of comparison, titanium oxide (average particle diameter: 0.27 μm) and particles (average particle diameter: 16 μm) of sodium sulfate, which was water-soluble, were used as two kinds of particles different in particle diameter to carry out a granulating operation in the same manner as described above, thereby obtaining an enzyme-containing granulated substance G. The resultant enzyme-containing granulated substances C to G in amounts of 0.1 g were separately stored in a laundry detergent containing 23% of a perborate as a bleaching ingredient under conditions of 40° C. and 80% relative humidity to determine the storage stability of the enzyme. The results are shown in Table 2.

TABLE 2

| Granulated substance | Component (a) | Component (b) | Binder | Retention of activity (seventh day) |
|---|---|---|---|---|
| C | Talc 26%* | Titanium oxide 4% | 3% | 28% |
| D | Zeolite 26% | Titanium oxide 4% | 3% | 20% |
| E | Kaolin 26% | Titanium oxide 4% | 3% | 32% |
| F | Activated clay 26% | Titanium oxide 4% | 3% | 20% |
| G | Sodium sulfate 26% | Titanium oxide 4% | 3% | 15% |

*Each blending amount is wt. % based on the total weight of the granulated substance.

As apparent from Table 2, it is understood that the enzyme-containing granulated substance of the present invention comprising the components (a) and (b) according to the present invention is far excellent in storage stability. Besides, it was observed that the granulated substance according to the present invention scarcely have dusting characteristics.

INDUSTRIAL APPLICABILITY

The enzyme-containing granulated substances according to the present invention are not only high in productivity but also low in dusting characteristics and high in storage stability, and are hence useful as formulation ingredients for detergents, in particular, bleacher-containing detergents.

We claim:

1. An enzyme-containing granulated substance comprising an enzyme-containing particulate substance and a coating layer which is formed on the particulate substance and comprises (a) water-insoluble or hardly water-soluble inorganic particles having an average particle diameter of 1 to 100 μm, (b) water-insoluble or hardly water-soluble inorganic particles having an average particle diameter of 0.01 to 0.8 μm and (c) a binder.

2. The granulated substance according to claim 1, wherein the enzyme-containing particulate substance includes an enzyme and particles of a water-soluble substance having a particle diameter of 0.2 to 1.2 mm.

3. The granulated substance according to claim 1, wherein the enzyme-containing particulate substance includes an enzyme, particles of a water-soluble substance having a particle diameter of 0.2 to 1.2 mm and a binder.

4. The granulated substance according to claim 2 or 3, wherein the particles of the water-soluble substance having a particle diameter of 0.2 to 1.2 mm are particles of a substance selected from sodium chloride, potassium chloride, Glauber's salt, sodium carbonate and sugar.

5. The granulated substance according to any one of claim 1 to 3, wherein (a) the water-insoluble or hardly water-soluble inorganic particles having an average particle diameter of 1 to 100 μm are particles of talc.

6. A process for the preparation of an enzyme-containing granulated substance according to claim 1, comprising forming, on an enzyme-containing particulate substance, a coating layer comprising (a) water-insoluble or hardly water-soluble inorganic particles having an average particle diameter of 1 to 100 μm, (b) water-insoluble or hardly water-soluble inorganic particles having an average particle diameter of 0.01 to 0.8 μm and (c) a binder.

7. The process according to claim 6, wherein the enzyme-containing particulate substance includes an enzyme and particles of a water-soluble substance having a particle diameter of 0.2 to 1.2 mm.

8. The process according to claim 6, wherein the enzyme-containing particulate substance includes an enzyme, particles of a water-soluble substance having a particle diameter of 0.2 to 1.2 mm and a binder.

9. The process according to claim 7 or 8, wherein the particles of the water-soluble substance having a particle diameter of 0.2 to 1.2 mm are particles of a substance selected from sodium chloride, potassium chloride, Glauber's salt, sodium carbonate and sugar.

10. The process according to claim 6, wherein (a) the water-insoluble or hardly water-soluble inorganic particles having an average particle diameter of 1 to 100 μm, are particles of talc.

11. The process according to claim 6, wherein the formation of the coating layer is performed by agitating and rolling granulation.

12. The process according to claim 6, wherein the preparation of the enzyme-containing particulate substance and the formation of the coating layer are performed by agitating and rolling granulation.

13. The granulated substance according to claim 4, wherein (a) the water-insoluble or hardly water-soluble inorganic particles having an average particle diameter of 1 to 100 μm are particles of talc.

14. A process for the preparation of an enzyme-containing granulated substance according to claim 4, comprising forming, on an enzyme-containing particulate substance, a coating layer comprising (a) water-insoluble or hardly water-soluble inorganic particles having an average particle diameter of 1 to 100 μm, (b) water-insoluble or hardly water-soluble inorganic particles having an average paticle diameter of 0.01 to 0.8 μm and (c) a binder.

15. A process for the preparation of an enzyme-containing granulated substance according to claim 5, comprising forming, on an enzyme-containing particulate substance, a coating layer comprising (a) water-insoluble or hardly water-soluble inorganic particles having an average particle diameter of 1 to 100 μm, (b) water-insoluble or hardly water-soluble inorganic particles having an average paticle diameter of 0.01 to 0.8 μm and (c) a binder.

16. A process for the preparation of an enzyme-containing granulated substance according to claim 2, comprising forming, on an enzyme-containing particulate substance, a coating layer comprising (a) water-insoluble or hardly water-soluble inorganic particles having an average particle diameter of 1 to 100 μm, (b) water-insoluble or hardly water-soluble inorganic particles having an average paticle diameter of 0.01 to 0.8 μm and (c) a binder.

17. A process for the preparation of an enzyme-containing granulated substance according to claim 3, comprising forming, on an enzyme-containing particulate substance, a coating layer comprising (a) water-insoluble or hardly water-soluble inorganic particles having an average particle diameter of 1 to 100 μm, (b) water-insoluble or hardly water-soluble inorganic particles having an average paticle diameter of 0.01 to 0.8 μm and (c) a binder.

* * * * *